US006820853B1

(12) United States Patent
DuBarry

(10) Patent No.: US 6,820,853 B1
(45) Date of Patent: Nov. 23, 2004

(54) ADJUSTABLE WALL DISPLAY

(76) Inventor: Suzanne DuBarry, 4691 White Oak Place, Encino, CA (US) 91316

( * ) Notice: Subject to any disclaimer, the term of this patent is extended or adjusted under 35 U.S.C. 154(b) by 0 days.

(21) Appl. No.: 10/397,118

(22) Filed: Mar. 26, 2003

(51) Int. Cl.[7] ..... A47G 1/16; G09F 7/18

(52) U.S. Cl. ..... 248/489; 248/493; 248/328; 248/495; 40/617; 211/70.5

(58) Field of Search ..... 211/70.5; 248/489, 248/466, 467, 493, 494, 495, 496, 320, 328; 40/617

(56) References Cited

U.S. PATENT DOCUMENTS

| | | | | |
|---|---|---|---|---|
| 394,144 A | | 12/1888 | Sword | |
| 442,629 A | * | 12/1890 | Lipscomb | 248/231.85 |
| 500,365 A | | 6/1893 | Berbecker | |
| 661,557 A | * | 11/1900 | Schwab | 52/27 |
| 779,433 A | | 1/1905 | Long | |
| 904,690 A | | 11/1908 | Francis | |
| 961,614 A | | 6/1910 | Johnson | |
| 980,947 A | * | 1/1911 | Held | 248/495 |
| 989,612 A | | 4/1911 | Kohn | |
| 1,107,686 A | | 8/1914 | Mehrmann | |

(List continued on next page.)

FOREIGN PATENT DOCUMENTS

EP 324466 A * 7/1989

*Primary Examiner*—Anita M. King

(57) ABSTRACT

A wall hanging device that allows multiple arrangements of displayed items with a single mounting structure reduces damage to the wall while allowing great versatility in the display. The device includes a mounting base that is fixably mounted to a wall or other supportive surface. The mounting base includes a plurality of substantially parallel support pins. At least one hanger cord with one end that is used to attach to a display item, such as a photograph, and the other end received by a support pin. The display item can hang directly under the end that is received by a support pin or be supported by one or more support pills with the end of the hanger cord being received by an adjacent support pin. The combination of multiple horizontal placement of the cord provides a wide variation of horizontal positioning. Supporting the cord on a support pin and securing the end of the cord to another pin provides vertical displacement of the display item depending upon the distance between the end of the cord relative to the vertical "hang" of the cord. Display items can be easily moved and changed without incurring additional physical damage to the wall.

39 Claims, 11 Drawing Sheets

U.S. PATENT DOCUMENTS

| | | | | | |
|---|---|---|---|---|---|
| 1,196,936 | A | | 9/1916 | Elsas et al. | |
| 1,226,019 | A | | 5/1917 | Schley | |
| 1,361,830 | A | * | 12/1920 | Cook | 248/493 |
| 1,442,036 | A | * | 1/1923 | Baker et al. | 248/495 |
| 1,996,552 | A | * | 4/1935 | Schwender | 211/106.01 |
| D156,600 | S | * | 12/1949 | Brown | D8/372 |
| 2,496,990 | A | * | 2/1950 | Downing | 248/493 |
| 2,754,974 | A | * | 7/1956 | Larson | 211/70.6 |
| 2,943,831 | A | | 7/1960 | Goss | 248/31 |
| 3,030,718 | A | * | 4/1962 | Kirkman | 40/617 |
| 3,226,065 | A | | 12/1965 | Smith | 248/32 |
| 3,312,434 | A | * | 4/1967 | Samuel | 248/62 |
| 3,424,422 | A | | 1/1969 | Klangos | 248/330 |
| 3,676,942 | A | * | 7/1972 | Elrod | 40/124.2 |
| 3,853,226 | A | * | 12/1974 | Hine et al. | 211/104 |
| 3,876,080 | A | * | 4/1975 | Hultberg et al. | 211/105.5 |
| D253,737 | S | * | 12/1979 | Brink | D6/552 |
| 4,221,024 | A | * | 9/1980 | Becker | 24/115 H |
| 4,392,316 | A | * | 7/1983 | Thomas | 40/617 |
| 4,399,918 | A | * | 8/1983 | Clements | 211/113 |
| 4,498,655 | A | * | 2/1985 | Tendler | 248/467 |
| 4,508,229 | A | * | 4/1985 | Yost, Jr. | 211/70.5 |
| 4,549,713 | A | | 10/1985 | Magadini | 248/495 |
| 4,567,682 | A | * | 2/1986 | Hurxthal | 40/617 |
| 4,973,021 | A | | 11/1990 | Schuite | 248/495 |
| 5,097,966 | A | * | 3/1992 | Miller | 211/87.01 |
| 5,193,694 | A | * | 3/1993 | Wave | 211/70.5 |
| 5,342,014 | A | | 8/1994 | Wilson | 248/476 |
| 5,606,816 | A | * | 3/1997 | Schwartz | 40/617 |
| 5,620,274 | A | * | 4/1997 | Wear | 403/171 |
| 5,813,549 | A | * | 9/1998 | Sheehan et al. | 211/87.01 |
| 6,055,754 | A | * | 5/2000 | Melhuus | 40/601 |
| 6,119,999 | A | * | 9/2000 | Fleishman | 248/489 |
| 6,164,617 | A | * | 12/2000 | Butterfield et al. | 248/690 |
| 6,212,810 | B1 | | 4/2001 | Jones | 40/757 |
| D444,633 | S | * | 7/2001 | Henick | D6/301 |
| 6,264,046 | B1 | * | 7/2001 | Ford | 211/59.1 |
| 6,416,026 | B1 | * | 7/2002 | Porraro | 248/317 |
| 6,591,528 | B2 | * | 7/2003 | Ellingsen | 40/601 |

* cited by examiner

ADJUSTABLE WALL DISPLAY

FIELD OF THE INVENTION

The present invention generally relates to arts and crafts. More specifically, the present invention relates to hanging wall displays such as pictures and the like.

BACKGROUND OF THE INVENTION

Wall art has been a part of our history for thousands of years. From cave art dated to over a million years ago, to modern day, mankind has told stories and beautified their dwellings and work places by placing art on the wall. In modern day, where wall finishes can also be an expensive work of art, driving a series of nail holes in the wall to support a single picture is undesirable. This is especially true in the case of a changing wall display, such as a type of displayed scrap-booking. Instead of creating attractive and sentimental images that are closed in a book, the images are displayed on a wall for all to see. Periodically these images can be removed and placed in a book for storage and a new display is created and displayed. This can be a vacation, graduation, birth, anniversary or birthday celebration or any other event that can be graphically displayed. In addition, traditional art can also be periodically rotated as furniture changes or the occupant simply desires a change. With traditional framing and mounting, this process would be very costly, and unless the same placement of photos was always used, the wall would be quickly destroyed by nail hole after nail hole. Adhesive wall mount tapes are not always reliable or can remove the wall finish with the tape when moved. A single rigid structure with multiple mounting capacity is preferred.

SUMMARY OF THE INVENTION

In one aspect, the invention comprises a display system including a mounting base with a plurality of support pins and at least one hanger cord. The hanger cord includes a pliable tensile member with an attachment ring on a first end. The ring is capable of being received by a support pin and at least one picture mount on a second end of the hanger cord. The tensile member is preferably a string, rope, cable, line or a cord. The plurality of support pins, preferably cylindrical in shape, extend away from a wall side of the mounting base and are substantially parallel to each other and includes a base cover to enclose the base, covering the support pins from view. The base cover includes a receiver channel to lock the cover in place and a finger ledge to assist the user in removing the cover from the base.

The system may also include a plurality of support pins that are cylindrical in shape and grouped in adjacent pairs with enough space there between to receive the tensile member. The plurality of support pins may include a center channel to receive the tensile member, or the center channel may include an hourglass shape with rounded upper and lower corners.

The second end of the hanger cord may include a pair of picture mounts located on the distal ends of a "Y" support. The hanger cord may have more than one "Y" support, one located distally to another. The picture mounts may be comprised of an adhesive backed bracket that is attached to the tensile member. The tensile member includes a mounting ring on a distal end of the second end thereof and the adhesive backed bracket includes a hook capable of receiving the mounting ring.

The indicator is preferably comprised of at least one mounting board this is attached to the picture mount. The mounting board can be a picture or photograph or a backing to attach a picture or photograph.

In another aspect, the invention includes a method of creating a wall mounted display system including the steps of providing a device as previously disclosed, mounting the base to a wall. The horizontal position of a picture mount is adjusted by supporting a hanger cord on at least one of a choice of the plurality of support pins. The vertical positioning is adjusted by moving the first end of the hanger cord and mounting the attachment ring on one of various a support pins.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
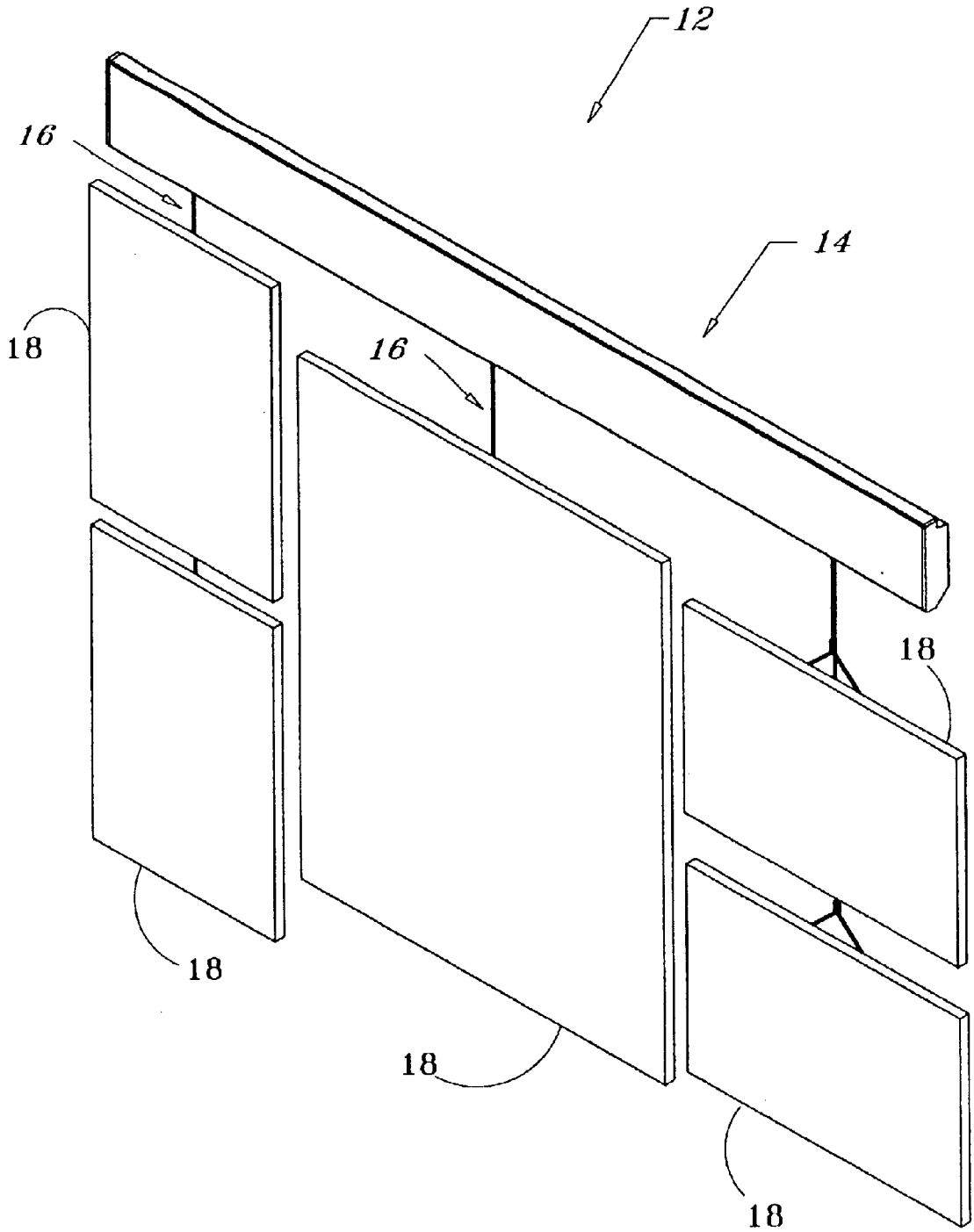
FIG. 1 is an isometric front view of one version of an adjustable wall display, the device produced in accordance with the present invention.

The present invention is used as an adjustable wall display 12 for artistic displays or information placards. Where it is desirable to alter the basic layout and/or the display items, the method of supporting the display items becomes very important. Where even the size of the photograph is changed or moved, in order to maintain an attractive and aesthetically pleasing display on the wall, the picture hangers would many times be moved. This means exposing an existing hole in the wall and creating a new hole. The display system 12 of the present invention is illustrated in FIG. 1. A mounting base 14 is mounted directly to the wall or other supportive surface. Hanger cords 16 are supported by the mounting base 14 to provide for a supportive medium for the display items 18. The display items 18 may be included as a component of the invention, but may also be a self provided item of the user. As such, the display items 18 are shown as a part of the invention 12 but it is understood that they are not considered integral to the novelty of the invention. The display items 18 as shown are used as illustrative purposes in that they can be photographs, paintings or any other art form or information placard. The display item can also be a structural element, such as foam board, cardboard, wood, metal or any other suitable material, which is capable of supporting a separate form of art or information to be displayed. In this case the display item 18 would include a flat planar surface to which an article for display can be mounted or attached. Though this can be in a permanent form, it is determined by the inventor that the articles be releaseably secured to the display item 18 by tape or some is form of mechanical fastener. This allows the articles of art or information to be changed without changing the display item 18.

Figure 2:
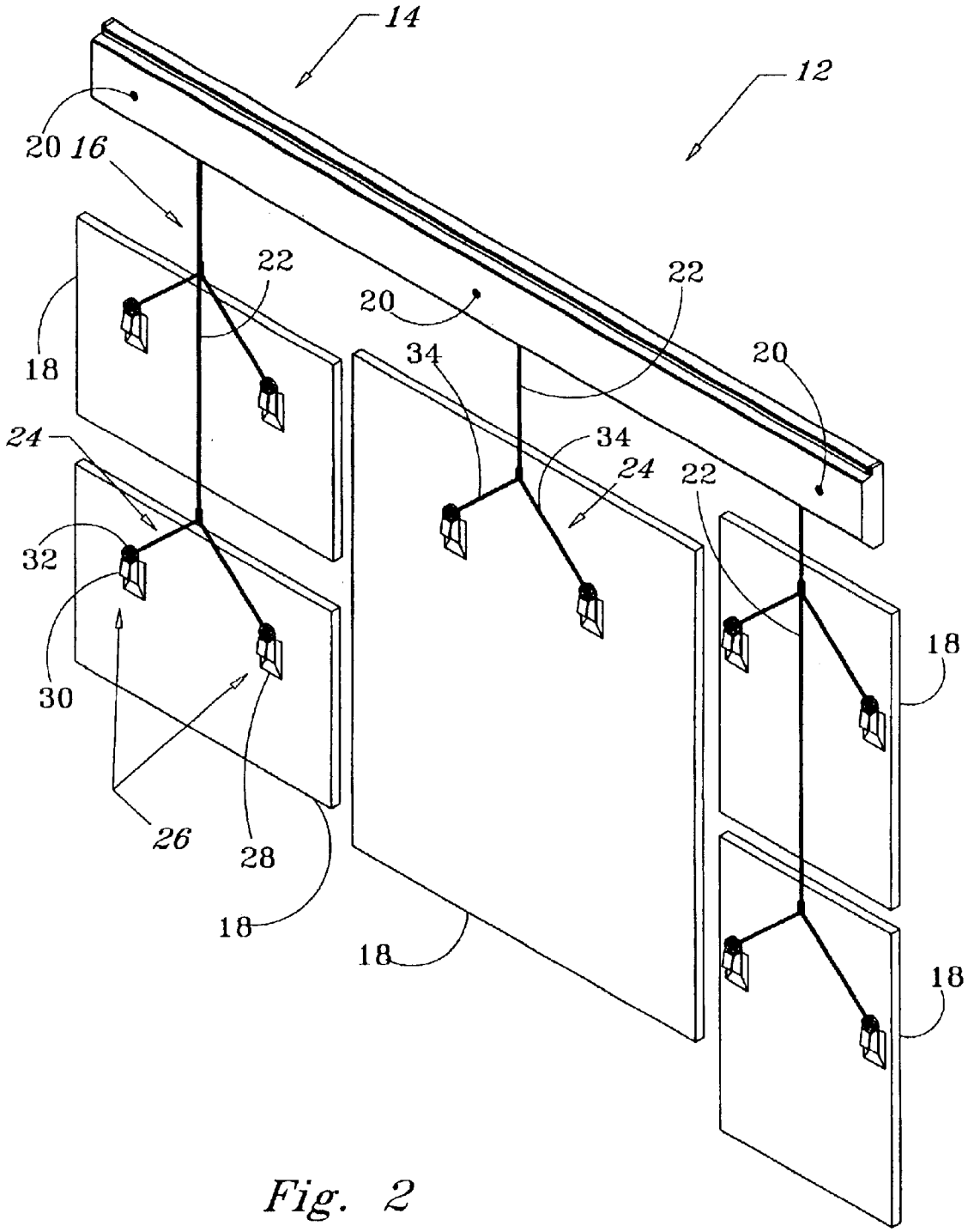
FIG. 2 is an isometric back view of one version of an adjustable wall display, the device produced in accordance with the present invention.

The display system 12 is shown from the rear in FIG. 2, as if the viewer is looking through the wall to which the invention 12 is mounted. Here the base 14 is shown to include mounting holes 20. These are one way of securing the invention 12 to the wall. Any number of fastening means common to the art such as threaded fasteners and nails can be used with these holes 20 to mount to the wall. These holes 20 are not considered critical and other forms of fasteners such as adhesive tape can also be used as a method of securing the base 14 to the wall.

The hanger cords 16 are shown here in two different forms and in three positions. The hanger cords 16 include a pliable tensile member 22 with a first end (not shown here) supported by the mounting base 14 and a second end 24 secured to the display items 18. This can be accomplished by several methods. What is shown here is the preferred embodiment, in that two picture mounts 26, comprised of an adhesive backed bracket 28, which includes a hook 30. The hook 30 receives a mounting ring 32 that is attached to the distal end of the second end of the tensile member 22. The releasable feature of the mounting ring 32 to the hook 30 allows for display items 18 to be easily and quickly mounted and removed. This adds to the versatility of the invention 12, though a simpler version of the invention 12 would remove the hook 30 and ring 32 and have the adhesive backed bracket 28 in a simplified form that is permanently attached to the distal end of the second end 24 of the hanger cord 16.

The hanger cords 16 are shown to include a "Y" support as part of the second end 24. This, though not necessary to the basic function of the invention 12, has been found to be useful in maintaining level support for the display items 18. It can be imagined that a single picture mount 26 could be used in the center of the display items 18, but if the single picture mount 26 was off from the center of mass of the item 18, it would tilt slightly. This may not be desirable to the user. As such, the "Y" support, which branches the tensile member into two equal legs 34, is used to provide much greater stability to the item 18.

Figure 3:
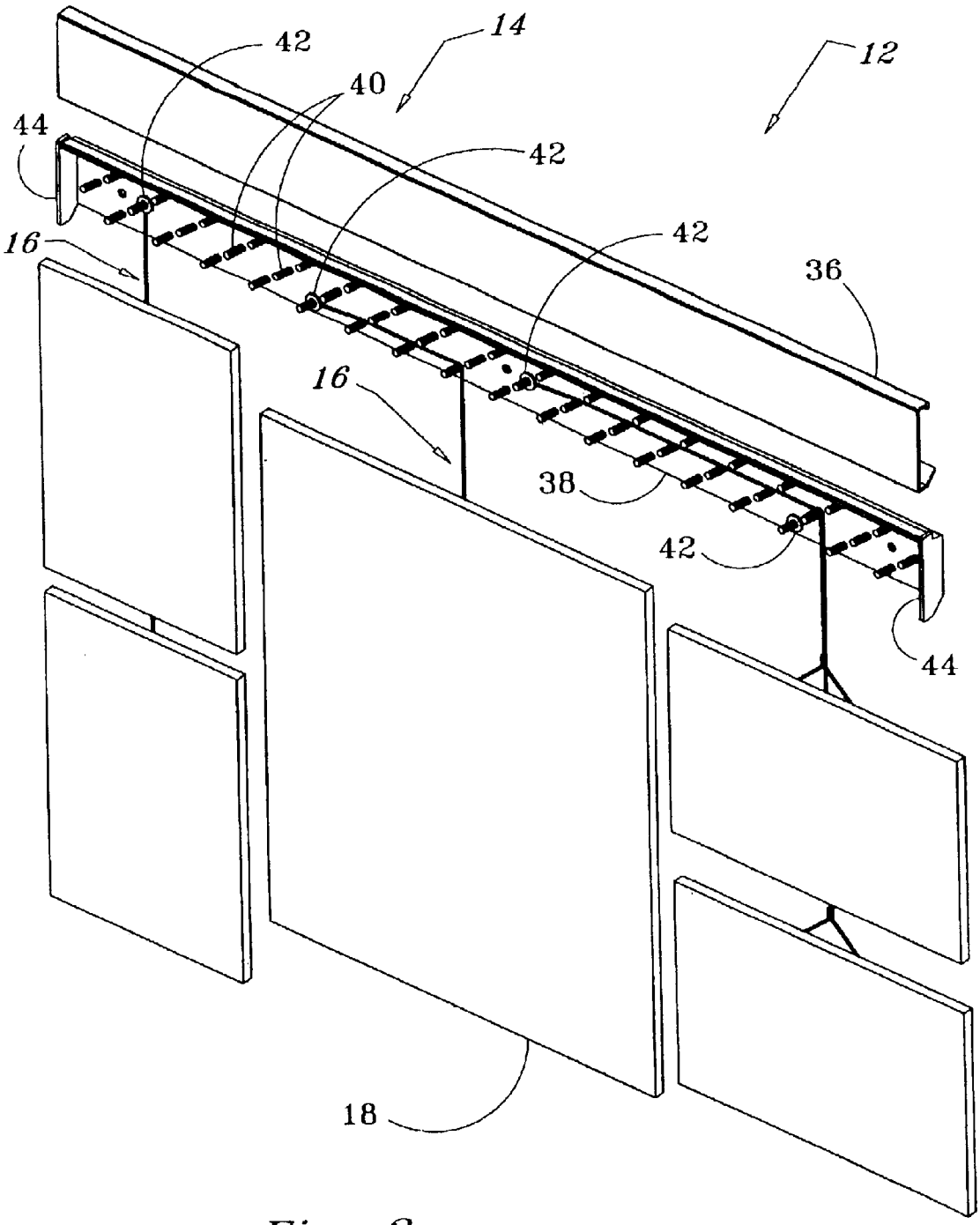
FIG. 3 is an isometric front view of an adjustable wall display with the front cover removed, the device produced in accordance with the present invention.

A front view of the invention 12 is shown in FIG. 3 with the base cover removed to show the internal structure of the mounting base 14. Extending from the back support 38 is a plurality of support pins 40. These pins 40 can be arranged in a variety of ways. The applicant has determined the preferred embodiment as being a series of rows being offset from the other, thereby creating a multitude of columns, some columns with exactly one pin 40. The purpose of the offset pin arrangement is to allow a multitude of horizontal positioning of each hanger cord 16 while minimizing the number of pins 40. The reduction in the number of pins 40 not only reduces the cost of production of the device 12, but allows greater room for the user's fingers to access and adjust the positions of the first end mounting ring 42 of the hanger cords 16. The variation in placement of the first end mounting ring 42 relative to the primary supporting pin 40 that the hanger cord 16 first contacts determines the vertical height of the display item 18. The back support 38 may also include ends 44 as shown here. The ends 44 serve as added structural support as well as close off the mounting base 14 to increase the attractive nature of the device 12.

Figure 4:
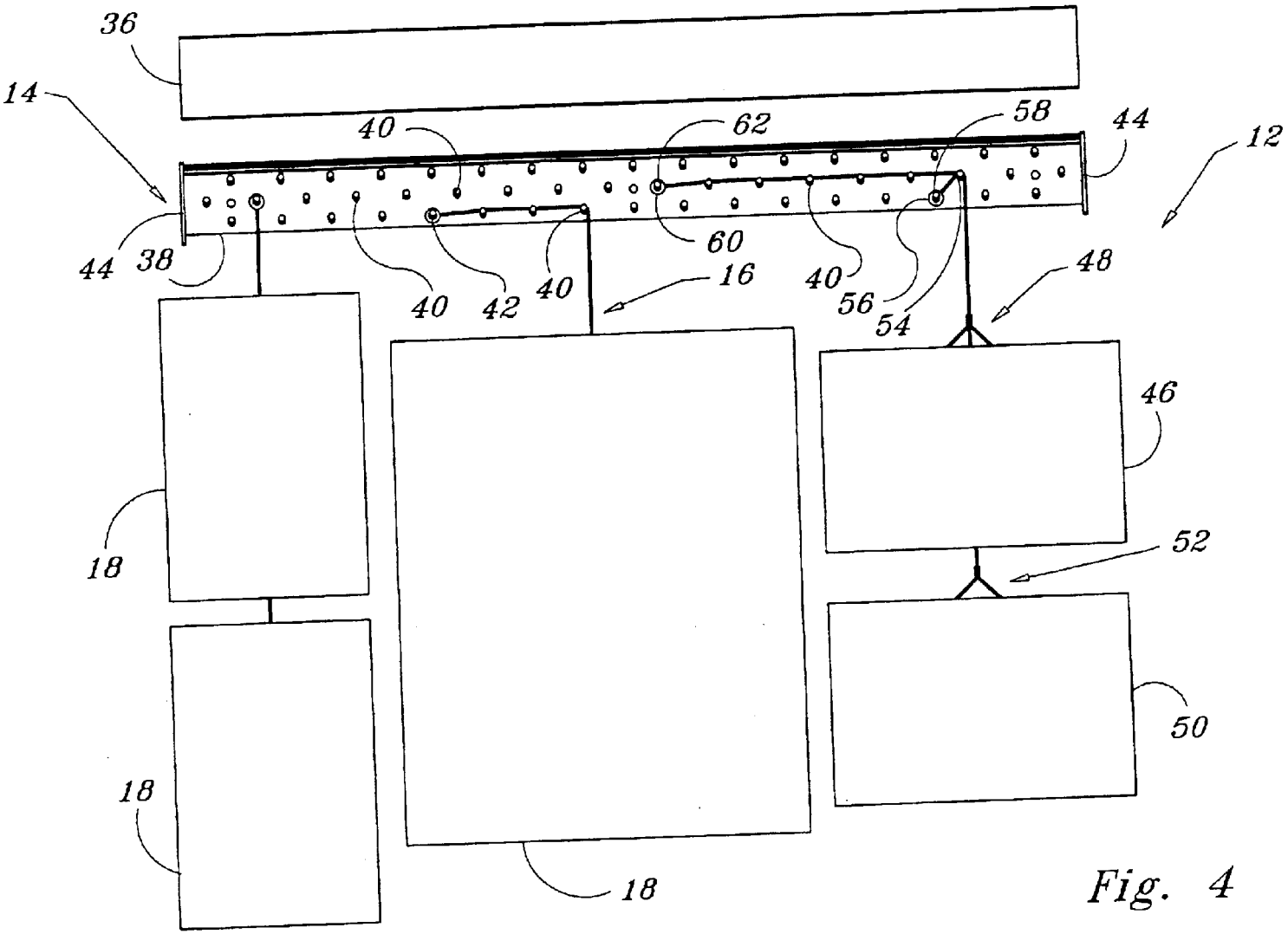
FIG. 4 is a front view of one version of an adjustable wall display with the front cover removed, the device produced in accordance with the present invention

The device 12 is shown looking straight on in FIG. 4. The display items 18 are supported by the hanger cords 16. The hanger cords 16 are supported by at least one pin 40. In most cases, as illustrated here, the hanger cords 16 hang over a first pin 40 with the first end mounting ring 42 received by another pin 40 in that or another row. As previously noted, this displacement determines the vertical height of the display item 18. This is illustrated on the right side of FIG. 4. Here the upper display item 46 and upper hanger cords 48 are identical to the lower display item 50 and lower hanger cord 52. Both hanger cords (48 & 52) are first supported by a support pin 54. The difference is the lower first end mounting ring 56 is secured to a pin 58 adjacent to the support pin 54. The upper first end mounting ring 60 is secured to a pin 62 several inches away from the support pin 54. The horizontal positioning of the display items 18 is provided by the abundance of pins, each capable of being used as a support pin, thus the display item 18 will hang directly underneath whatever pin is selected.

Figure 5:
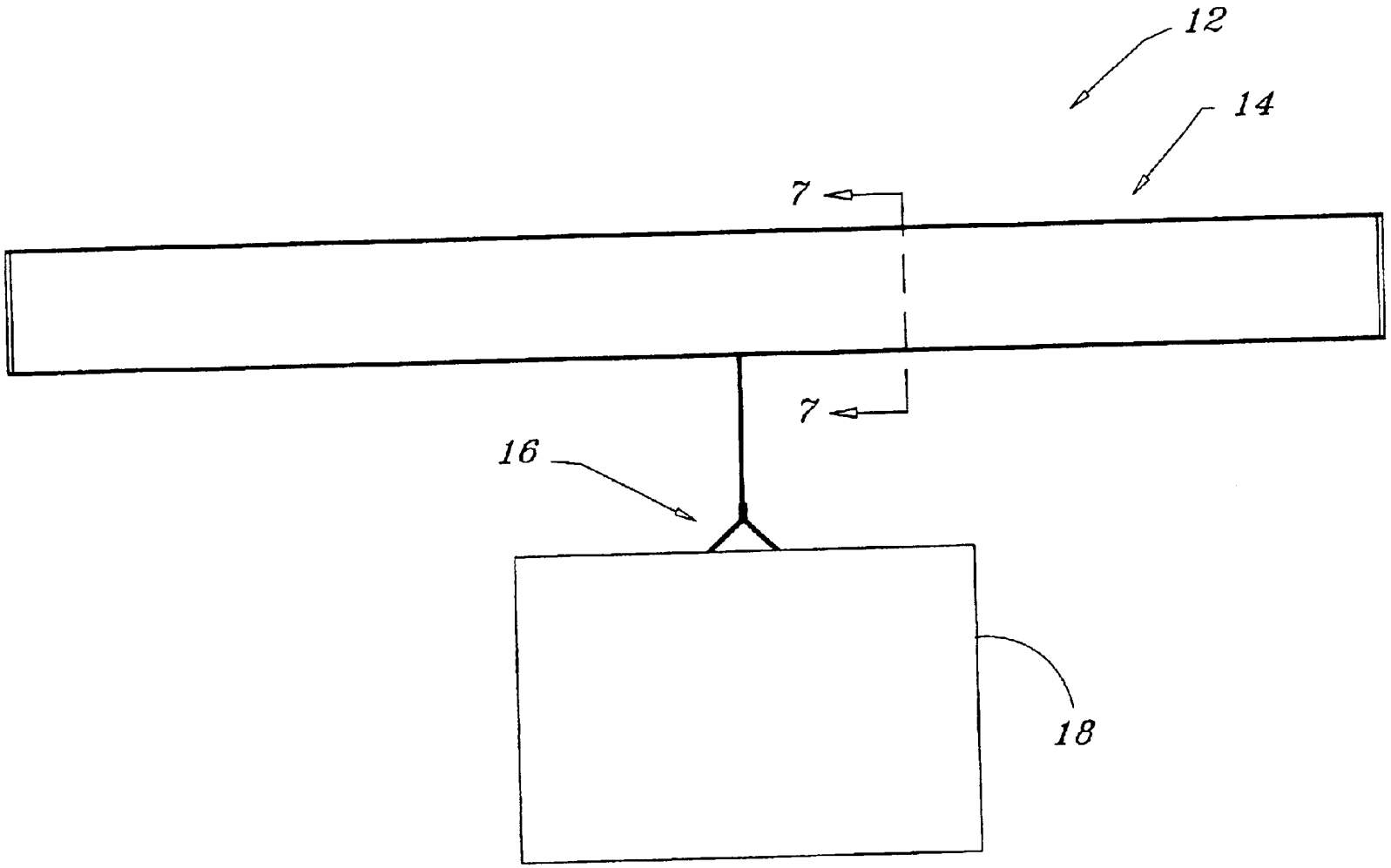
FIG. 5 is a front view of an adjustable wall display with a single hanging display, the device produced in accordance with the present invention.
Figure 6:
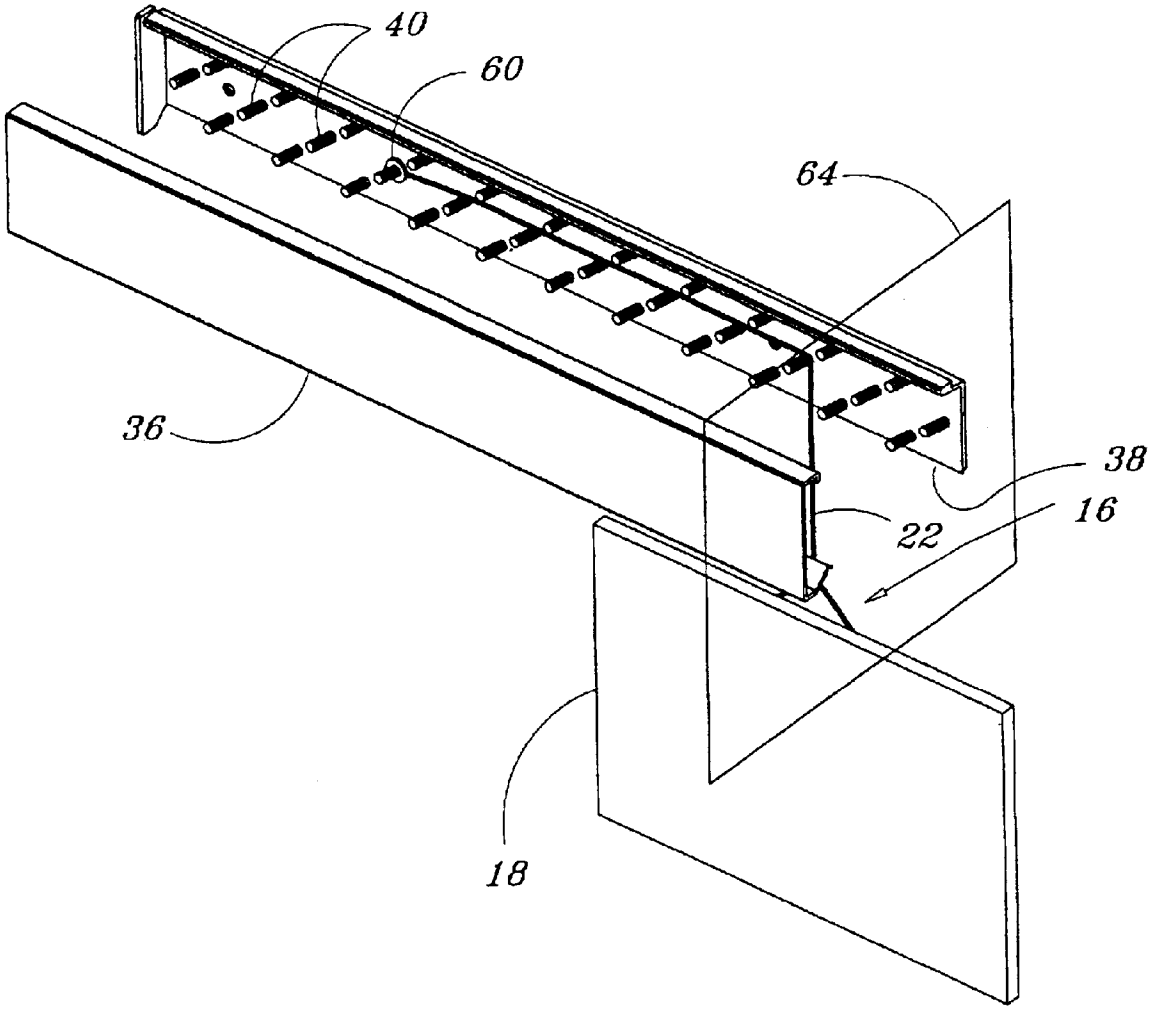
FIG. 6 is an isometric front view of one version of an adjustable wall display showing the section 7—7, the device produced in accordance with the present invention.

A simplified version on the invention 12 is shown in FIG. 5 showing a single display item 18. A section line 7—7 shows the section of the base 14. This is also illustrated in FIG. 6 where an isometric exploded view is used with a plane 64 showing the section 7—7. Here only one display item 18 is used, but it can be easily seen that a multitude could be used. The section is made to show the features of the base cover and back support 38. The base cover is an enclosure structure of the mounting base 14. The base cover 36 is used primarily for aesthetic purposes, to cover the first end mounting rings 60, ends of the hanger cords 16 and pins 40. A secondary feature is that the bottom portion of the cover 36 is used as a support for the tensile member 22 of the hanger cord 16 as, when assembled, it is pinched between the bottom edge of the cover 36 and the back support 38. This helps stabilize the display items 18.

Figure 7:
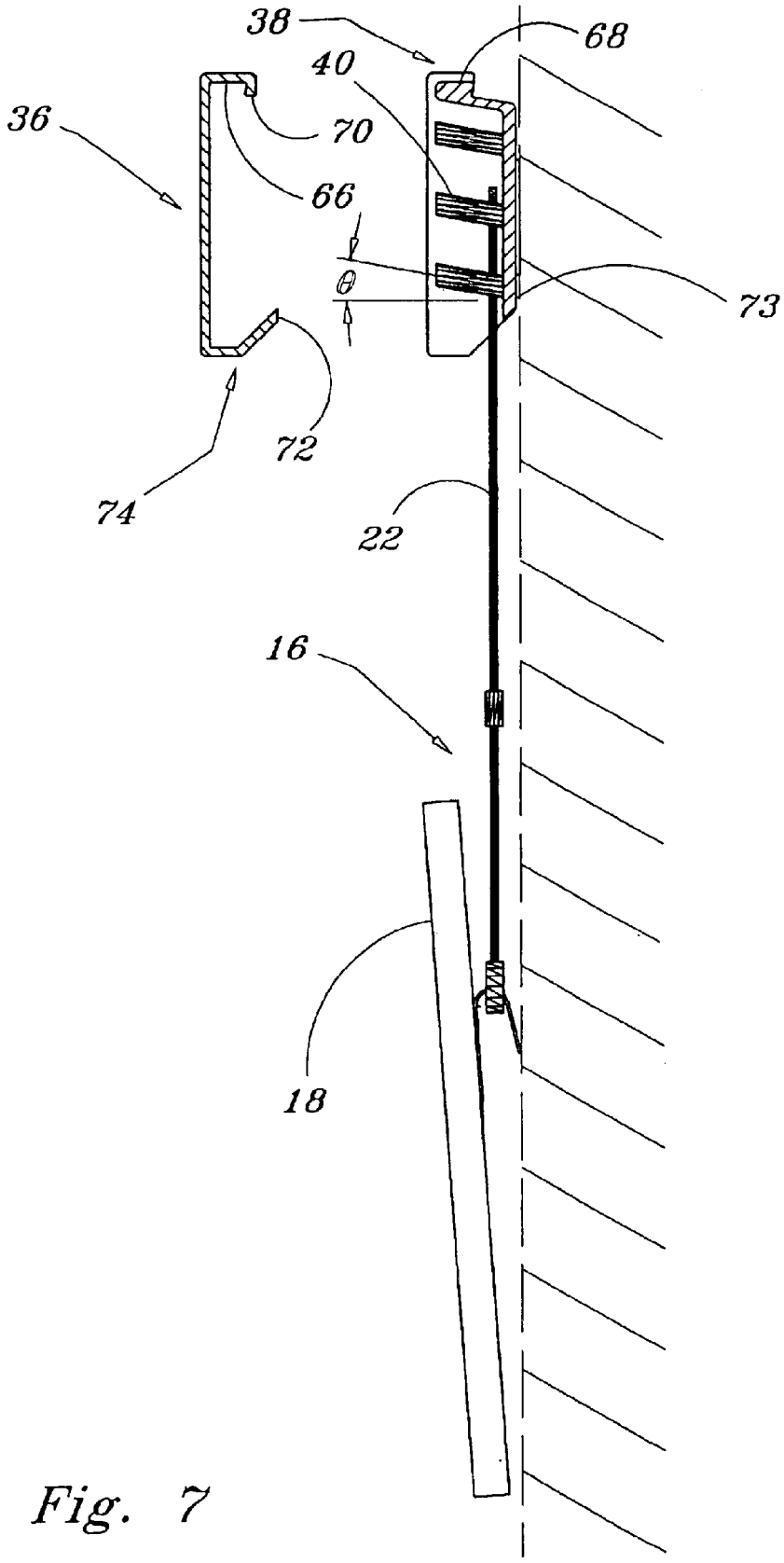
FIG. 7 is a sectioned side view of an adjustable wall display, the device produced in accordance with the present invention.

More detail of the cover 36 and back support 38 are illustrated in the section shown in FIG. 7. The cover 36 includes a receiver channel 66 that is received by a frame lip 68 on the back support 38. The receiver channel 66 is preferably a concave type structure, such as the shortened "U" as shown here in cross-section. Using such a from that is slightly narrower than the frame lip 68 an interference is provided that will flex the free end 70 of the channel 66 when it is fitted over the lip 68. This "locks" the cover 36 on the back support 38 to hold it in place and push the bottom edge 72 of the cover 36 against the back plate 74 back plate 73 of the back support 38, pinching the tensile member 22 of the hanger cord 16 there between. The cover 36 must be removed every time the user needs to change the orientation of the display. To assist with the removal process the lower portion of the cover 36 includes a finger ledge 74. This is a turned up lip that allows the user to grab the ledge 74 with the tips of the user's fingers. The user can then pull the cover 36 off the back support 38, overcoming the tension provided by the interference of the channel 66 and lip 68.

Another item that is illustrated is the angle of incidence of the pins 40. Though not considered mandatory, it is many times desirable to tilt the pins 40 up slightly. This angle with respect to the normal, or angle of incidence is represented by the angle θ. It has been determined by the inventor that the optimal angle is 10°. A variation of plus 20° or minus 10° is acceptable and may be considered advantageous depending upon the material of the pins, weight of the hanging items and type of cord used.

Figure 8:
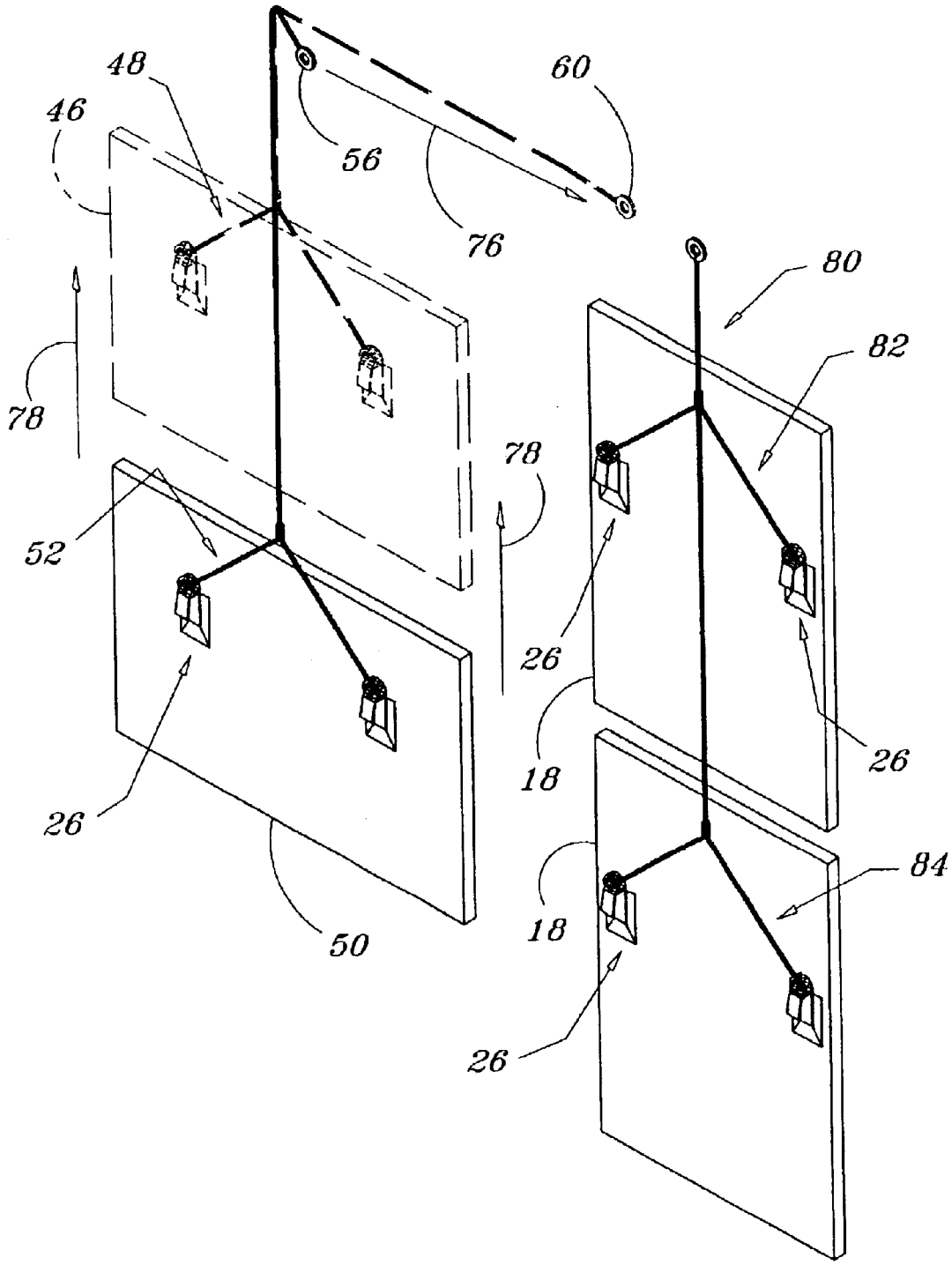
FIG. 8 is an isometric view of the backside of the display portions of an adjustable wall display, the device produced in accordance with the present invention.
Figure 9A:
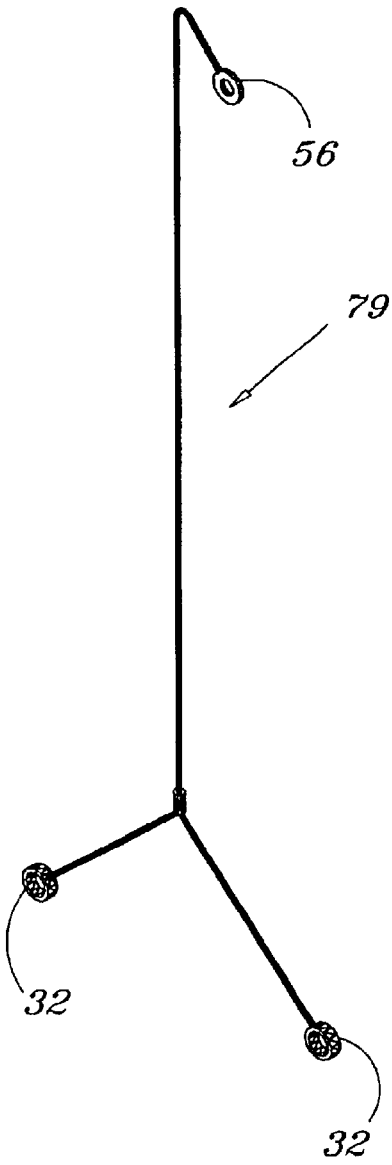
FIG. 9*a* and FIG. 9*b* are isometric views of a single and double hanger of an adjustaable wall display respectively, the device produced in accordance with the present invention.
Figure 9B:
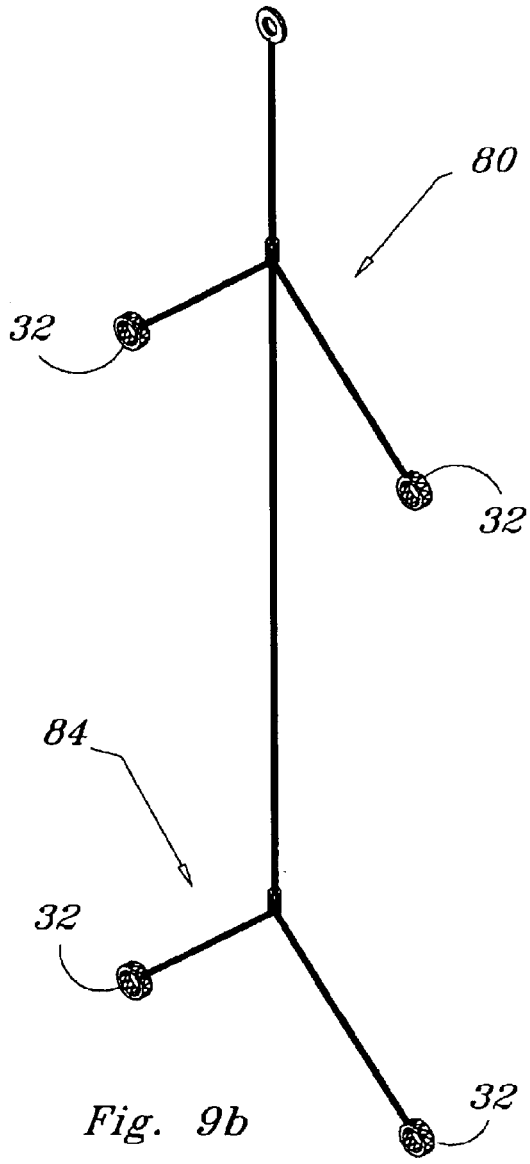

The adjustment of the height of the display items 18 and the variation in the hanger cords is shown in FIG. 8. As was shown in FIG. 4, the upper display item 46 and upper hanger cord 48 is the lower display item 50 and lower hanger cord 52 in a second or raised position. The lower first end mounting ring 56 is visibly displaced from the upper first end mounting ring 60 as illustrated by the arrow 76. This displacement is the change in vertical orientation of the lower display item 50 to the position of the upper display item 46 as depicted by the vertical arrows 78. Another form of hanger is the double "Y" hanger cord 80, which has an upper pair of picture mounts 26 connected to an upper "Y" branch 82 and a lower pair of picture mounts 26 connected to a lower branch 84. This variation can include three or more "Y" branches all connected as part of one hanger cord. The advantage to such a component is that display items 18 can be mounted without requiring individual vertical adjustment. The single 79 and double "Y" hanging cords are shown alone in FIG. 9*a* and FIG. 9*b* respectively.

Figure 10:
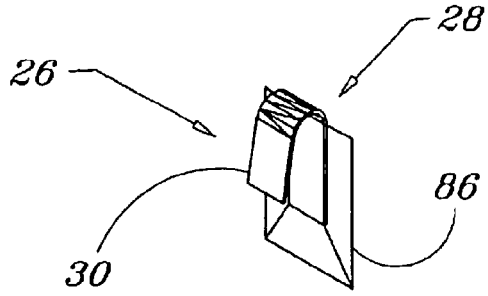
FIG. 10 is an isometric view of a picture mount hook used in an adjustable wall display, the device produced in accordance with the present invention.

A picture mount 26 is shown in greater detail in FIG. 10. The picture mount 26 is comprised of an adhesive backed bracket 28, which includes a hook 30. The hook 30 receives the mounting ring 32 that is attached to the distal end of the second end of the tensile member 22, as shown in FIG. 9. The adhesive back 86 may be a single piece of tape that is mechanically fastened to the bracket 28 or the adhesive tape may cross the bracket 28, adhering thereto as well, while leaving free ends of the tape to adhere to the back of a display item 18.

Figure 11:
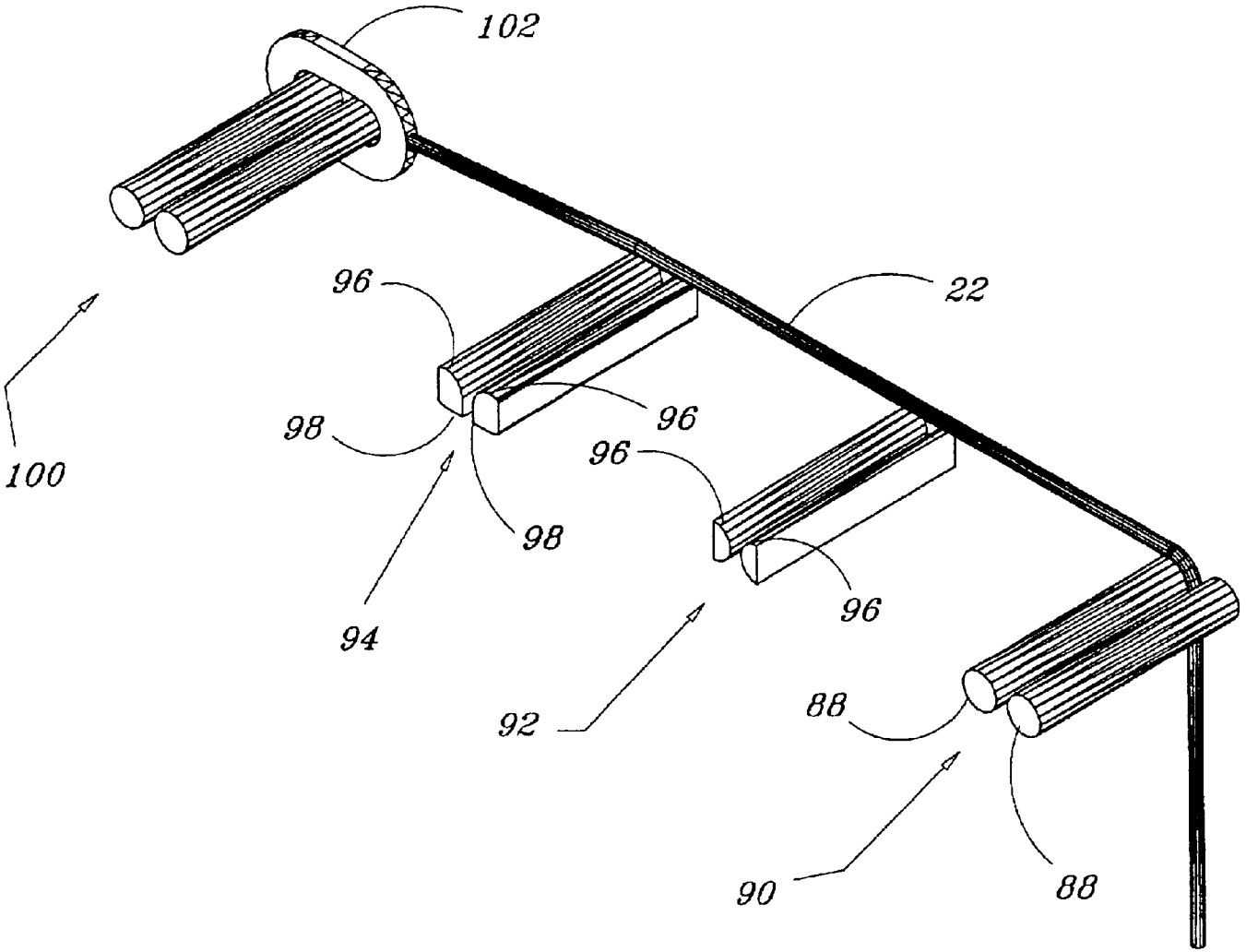
FIG. 11 is an isometric front view of three versions of mounting pins of an adjustable wall display, the device produced in accordance with the present invention.

Another variation to the invention is shown in FIG. 11. The pins 40 can be a single cylindrical rod, as disclosed thus far, or modified to provide support in either a left or a right direction. This allows the tensile member 22 to pass through or between the sides of the pin to provide consistent vertical alignment of the tensile member 22 regardless as to the direction of wrap of the tensile member 22 or if the tensile member 22 is secured directly to the pin. Examples of variations of this pin include adjacent sub-pins 88. With a space between the closest points of these sub-pins 88 being slightly greater than the width of the tensile member 22, the duel pin 90 maintains a consistent horizontal positioning of the tensile member 22 regardless of the direction the tensile member is located above the pin 90. Two variations of hourglass cutouts of pins are shown. A narrow base cutout pin 92 and a wide base cutout pin 94 are similar in that both have rounded edges on the top edges 96. This provides less stress in the tensile member 22 that passes over those edges. The wide base cutout pin 94 has flat lower edges 98 on the bottom portion, in that any cord that contacts the pin 94 does not bend on the bottom edge. This creates a modified hourglass cutout with a rounded top and straight from the center down. A second duel pin 100 is shown with an elongated first end mounting ring 102 received there on. This ring 102 is shown to illustrate that any form of pin can be met with an appropriate ring 102 to fit that shape.

Figure 12A:
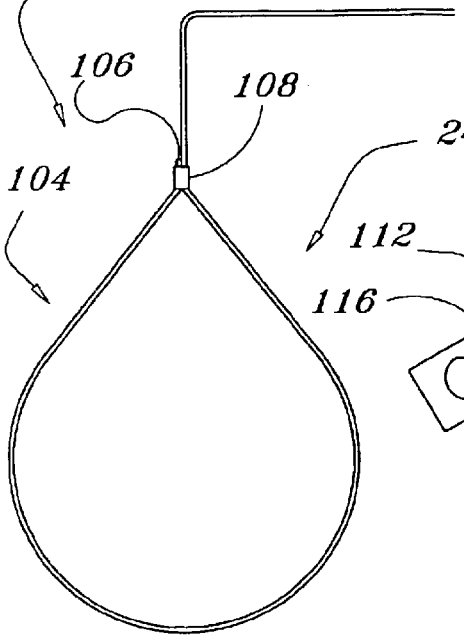
FIG. 12*a* and FIG. 12*b* are front views of another version of a second end of a hanger cord shown in a relaxed position and a loaded position respectively, the device produced in accordance with the present invention.
Figure 12B:
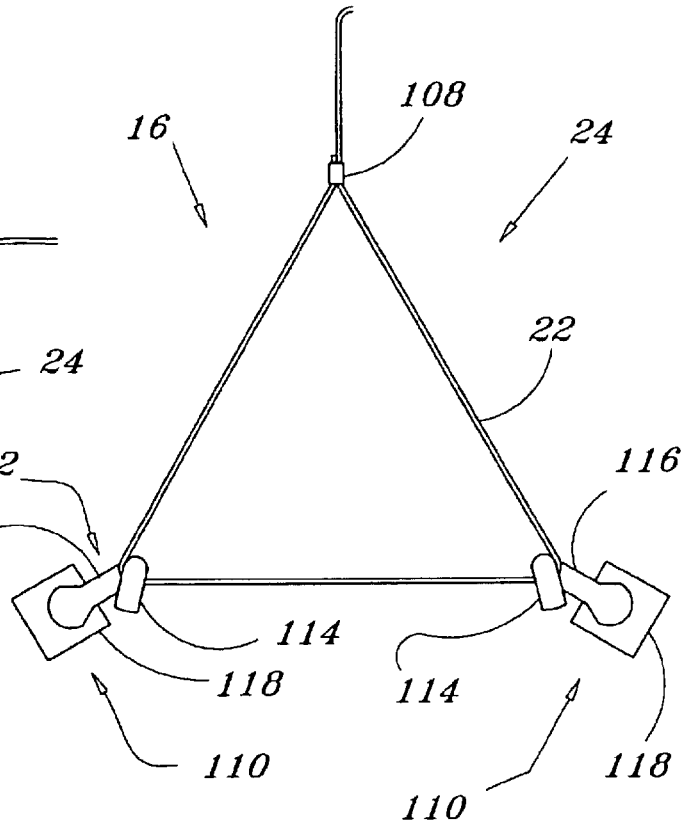

An alternate form of the second end 24 of the hanger cord 16 is shown in FIG. 12*a* and FIG. 12*b*. In this, two positions of the second end 24 are shown. In this form the second end 24 is a loop 104 that is made by taking the free end 106 of the tensile member 22 and securing it to a higher point on the tensile member 22 by use of a clip 108. This is illustrated in FIG. 12*a* where the loop 104 created is in a relaxed state. If so desired, a second loop made from a second tensile member could be suspended from the same clip 108, thus making two or more loops 104 that lie in series with one another. This process could be done any number of times to create a long string of loops 104. In function, this is similar to items 80 and 84 in FIG. 9*a* and FIG. 9*b*.

The second end 24 of FIG. 12*a* is shown in a loaded position in FIG. 12*b*. Brackets 110 are fastened to the display item as previously disclosed. In this view the brackets 110 include a hook 112, which is comprised of a bent cylindrical wire. This wire 112 is preferably bent to form a receiver for the tensile member 22. The bent portion 114 can be in the same plane as the base portion 116 or bent to form an acute angle relative to the base portion 116, as shown here. The angled bent portion 114 provides a simple substantially vertical "hook" portion while the resultant load vector on the device is approximately through the long axis of the base portion 116. This gives an even stress on the mounting 118. The base portion 116 includes some form of mounting 118 so that it can be attached to the display item. This can be any form as previously disclosed or as is other wise known in the art. The resultant shape of the second end 24 in a loaded state is substantially a triangle.

Figure 13:
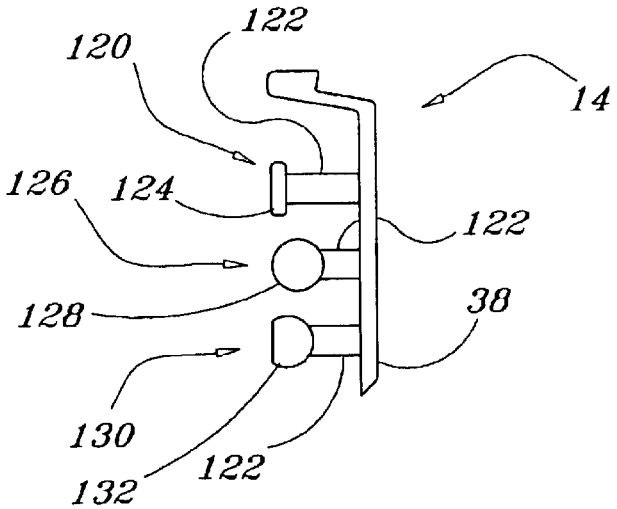
FIG. 13 is a side view of a back support of a base showing a variety of pins, the device produced in accordance with the present invention.

An alternative to the pins attached to the back support 38 of the base 14 is shown in FIG. 13 and shown in cross-section as in FIG. 7. It was previously disclosed in FIG. 7 that the pins were tilted up slightly. The angle of incidence (θ) helps keep the tensile member on the pin and toward the back support 38, thus nearer the wall when mounted thereon. Other forms of retaining the tensile members on the pins are shown here. The upper pin 120 includes a shaft 122 and a ring 124 on the distal end. The middle pin 126 also has a shaft 122, but a spherical cap 128 is placed on the distal end. On the bottom pin 130, a truncated sphere 132 caps the shaft 122. In each case the oversized end reduces inadvertent disengagement of the tensile member 22 from the shaft 122 of the pin.

What is claimed is:

1. A display system comprising:

a mounting base including a plurality of support pins;

a base cover adapted to be mounted to said mounting base enabling covering a support pin; and at least one hanger cord including a pliable tensile member with an attachment ring on a first end, the ring capable of being received by a support pin and at least one picture mount on a second end of the hanger cord.

2. A display system as in claim 1, wherein said tensile member is a member selected from the group consisting of a string, rope, cable, line and a cord.

3. A display system as in claim 1, wherein said plurality of support pins extend away from a wall side of said mounting base and are substantially parallel to each other.

4. A display system as in claim 1, wherein said plurality of support pins have an angle of incidence of 10 degrees.

5. A display system as in claim 1, wherein said plurality of support pins include an oversized head.

6. A display system as in claim 1, wherein said plurality of support pins are arranged in more than one row.

7. A display system as in claim 6, wherein said support pins are offset such that at least some columns have exactly one pin.

8. A display system as in claim 1, wherein said base cover includes a receiver channel and a finger ledge.

9. A display system as in claim 1, wherein said plurality of support pins are cylindrical in shape.

10. A display system as in claim 1, wherein said plurality of support pins are substantially cylindrical in shape and grouped in adjacent pairs with enough space there between to receive said tensile member.

11. A display system as in claim 1, wherein said plurality of support pins includes a center channel to receive said tensile member.

12. A display system as in claim 11, wherein said center channel has an hourglass shape.

13. A display system as in claim 1, wherein said second end of said hanger cord includes a pair of picture mounts located on distal ends of a "Y" support.

14. A display system as in claim 13, wherein said hanger cord has more than one "Y" support, one located distally to another.

15. A display system as in claim 1, wherein said second end of said hanger cord is formed into at least one loop.

16. A display system as in claim 1, wherein said at least one picture mount is comprised of an adhesive backed bracket that is attached to said tensile member.

17. A display system as in claim 16, wherein said bracket is releaseably attached to said tensile member.

18. A display system as in claim 16, wherein said tensile member includes a mounting ring on a distal end of said second end thereof and said adhesive backed bracket includes a hook capable of receiving said mounting ring.

19. A display system as in claim 1, further comprising at least one mounting board attached to said picture mount.

20. An ornamental display system comprising:

a base suitable for mounting on a wall;

a base cover adapted to be mounted to said base enabling covering a support pin;

a plurality of support pins on said base and extending from said base; and at least one hanger cord including a pliable tensile member with an attachment ring on a first end, the ring capable of being received by a support pin and at least one picture mount on a second end of the hanger cord.

21. A display system as in claim 20, wherein said tensile member is a member selected from the group consisting of a string, rope, cable, line and a cord.

22. A display system as in claim 20, wherein said plurality of support pins are substantially parallel to each other.

23. A display system as in claim 20, wherein said plurality of support pins have an angle of incidence of 10 degrees.

24. A display system as in claim 20, wherein said plurality of support pins include an oversized head.

25. A display system as in claim 20, wherein said plurality of support pins are arranged in more than one row.

26. A display system as in claim 25, wherein said support pins are offset such that at least some columns have exactly one pin.

27. A display system as in claim 20, wherein said base cover includes a receiver channel and a finger ledge.

28. A display system as in claim 20, wherein said plurality of support pins are cylindrical in shape.

29. A display system as in claim 20, wherein said plurality of support pins are substantially cylindrical in shape and grouped in adjacent pairs with enough space there between to receive said tensile member.

30. A display system as in claim 20, wherein said plurality of support pins includes a center channel to receive said tensile member.

31. A display system as in claim 30, wherein said center channel has an hourglass shape.

32. A display system as in claim 20, wherein said second end of said hanger cord includes a pair of picture mounts located on distal ends of a "Y" support.

33. A display system as in claim 32, wherein said hanger cord has more than one "Y" support, one located distally to another.

34. A display system as in claim 20, wherein said second end of said hanger cord is formed into at least one loop.

35. A display system as in claim 20, wherein said at least one picture mount is comprised of an adhesive backed bracket that is attached to said pliable tensile member.

36. A display system as in claim 35, wherein said bracket is releaseably attached to said pliable tensile member.

37. A display system as in claim 35, wherein said tensile member includes a mounting ring on a distal end of said second end thereof and said adhesive backed bracket includes a hook capable of receiving said mounting ring.

38. A display system as in claim 20, further comprising at least one mounting board attached to said picture mount.

39. For use with a display system including a mounting base with a plurality of support pins, a base cover adapted to be mounted to the mounting base and at least one hanger cord including a pliable tensile member with an attachment ring on a first end and a picture mount on a second end, a method of creating a wall mounted display system including the steps of:

mounting said mounting base to a wall;

adjusting the horizontal position of said picture mount by supporting said hanger cord on at least one of said plurality of support pins;

adjusting the vertical position of said picture mount by mounting said attachment ring on at least one of said plurality of support pins; and providing a mounting board and securing it to said picture mount.

* * * * *